166-66 SR
M7219 OR 4,102,394

United States Patent [19] [11] 4,102,394
Botts [45] Jul. 25, 1978

[54] CONTROL UNIT FOR OIL WELLS

[75] Inventor: Elton M. Botts, Mattoon, Ill.

[73] Assignee: Energy 76, Inc., Mattoon, Ill.

[21] Appl. No.: 805,569

[22] Filed: Jun. 10, 1977

[51] Int. Cl.[2] ..... E21B 43/00
[52] U.S. Cl. ..... 166/65 R; 166/113; 318/11; 340/163
[58] Field of Search ..... 166/113, 75, 53, 64, 166/65 R, 66, 68, 68.5, 104; 318/11, 16; 340/163, 200, 600

[56] References Cited

U.S. PATENT DOCUMENTS

| | | | |
|---|---|---|---|
| 2,604,850 | 7/1952 | Carlin et al. | 166/68.5 |
| 2,864,040 | 12/1958 | Trotsky | 318/11 |
| 3,350,687 | 10/1967 | Gabrielson et al. | 340/163 |
| 3,921,152 | 11/1975 | Hagar et al. | 166/65 R |

*Primary Examiner*—James A. Leppink
*Attorney, Agent, or Firm*—Clarence A. O'Brien; Harvey B. Jacobson

[57] ABSTRACT

A control unit for oil wells for maximizing the efficiency of a producing oil well field, including the use of a variable speed AC motor powering each oil well pump jack, which enables the operator to control the strokes per minute on the pump unit and adjust the speed of the upstroke relative to the downstroke of the unit which is accomplished by the variable speed motor also having a variable cycle. This enables the operator to adjust the speed of the pump jack to pump all the oil that the formation will yield and also slowdown the downstroke so that excessive pounding against fluid columns and the resulting shock and vibration of the rod, tubing, pump and pump jack can be substantially eliminated. Other controls, such as high and low power cut out, temperature control, vibration sensor, flow meter, chemical analysis and injector device, and the like, may be incorporated into the control unit, with the conditions of each oil well being transmitted to a central location remote from the individual producing wells in an oil field, thereby reducing the necessity of personnel periodically inspecting the pumping unit at each oil well. Security devices are provided to reduce the possibility of unauthorized persons trespassing in the oil field.

8 Claims, 5 Drawing Figures

CONTROL UNIT FOR OIL WELLS

BACKGROUND OF THE INVENTION

1. Field of the Invention

The present invention generally relates to a control unit for oil well pumps and more particularly to a device which will enable adjustment of various conditions encountered by a pumping unit for an oil well and to monitor the conditions at each well site and transmit such information to a central location.

2. Description of the Prior Art

The technique of pumping oil from oil wells has not substantially changed for many years with the incidence of broken pump rods, worn out pumps, engine failures, holes in tubing, flow line breakage, and the like, being almost predictable depending upon the pumping conditions at each individual oil well. The "downtime" of the pump reduces the production capability of the well. Generally, personnel are hired to periodically visit the well site and inspect the well pumping operation. While some efforts have been made to provide some variation in the operation of oil well pumping units, presently used pump jacks are normally operated at a constant speed and cycle which frequently introduces inefficiency since the pumping capacity of the pump for each stroke of operation is frequently substantially more than the volume of fluid produced by the formation. Also, downstroke of the pump plunger frequently results in pounding against a fluid column. In the event of failure of a pumping component, the entire pumping unit will become inoperative and, in some cases, even cause major damage to some of the components, since the frequency of inspection by personnel leaves the pumping unit completely unmonitored for extended time periods. All of the above mentioned factors, including the expense of hiring personnel, results in relatively high operating cost for a producing oil well.

SUMMARY OF THE INVENTION

An object of the present invention is to provide a control unit for oil wells which includes a variable speed and variable cycle AC motor powering the pump jack to maximize efficiency of the pump so that the capacity volume of the pump for each stroke will be equal to the production capability of the formation in the time interval required for each stroke of operation of the pump and the upstroke and downstroke of the pump may be varied so that the upstroke may be relatively fast while the downstroke may be slow to eliminate pounding against fluid columns during the downstroke, thereby not only maximizing efficiency of the pump but reducing vibration and other possibly damaging conditions caused by pounding to increase the longevity of the pump unit.

Another object of the invention is to provide a control unit for oil wells, in accordance with the preceding object, in which the pumping conditions at each oil well can be transmitted to a central location by a transceiver unit and recorded in a manner to enable the operating conditions at each oil well to be continuously monitored and controlled at a remote location thereby thereby reducing the personnel necessary to produce oil from a plurality of oil wells.

A further object of the present invention is to provide a control unit for oil wells for reducing the cost of lifting and handling crude oil and rendering the pumping operation more nearly automatically controlled and substantially reducing the incidence of major damage due to faulty or inaccurate human control of the oil well pumping units.

Still another object of the invention is to provide a control unit for oil wells which is easily installed on old wells or incorporated into new wells when they are being placed into production with the control unit being self-contained, easily maintained and including a security device to sense and record the presence of unauthorized personnel adjacent the oil well site.

These together with other objects and advantages which will become subsequently apparent reside in the details of construction and operation are more fully hereinafter described and claimed, reference being had to the accompanying drawings forming a part hereof, wherein like numerals refer to like parts throughout.

DESCRIPTION OF THE PREFERRED EMBODIMENT

Figure 1:
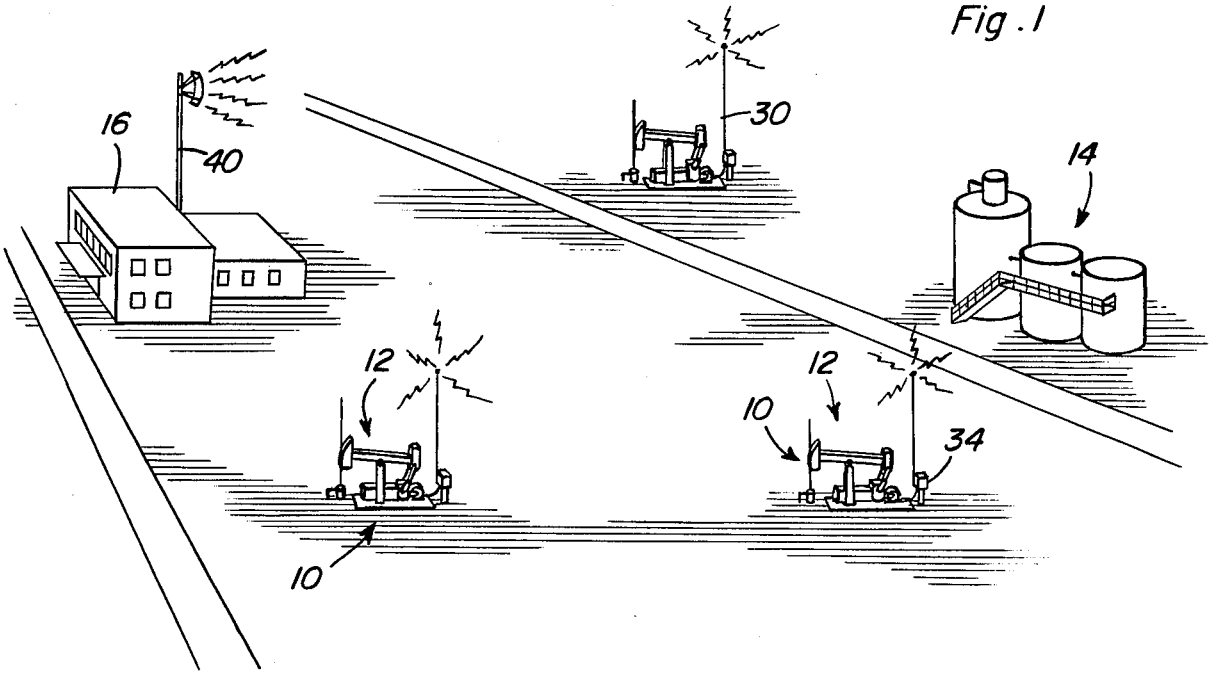
FIG. 1 is a schematic view of an oil field illustrating a plurality of oil wells, storage tanks and a remote centrally located building.
Figure 3:
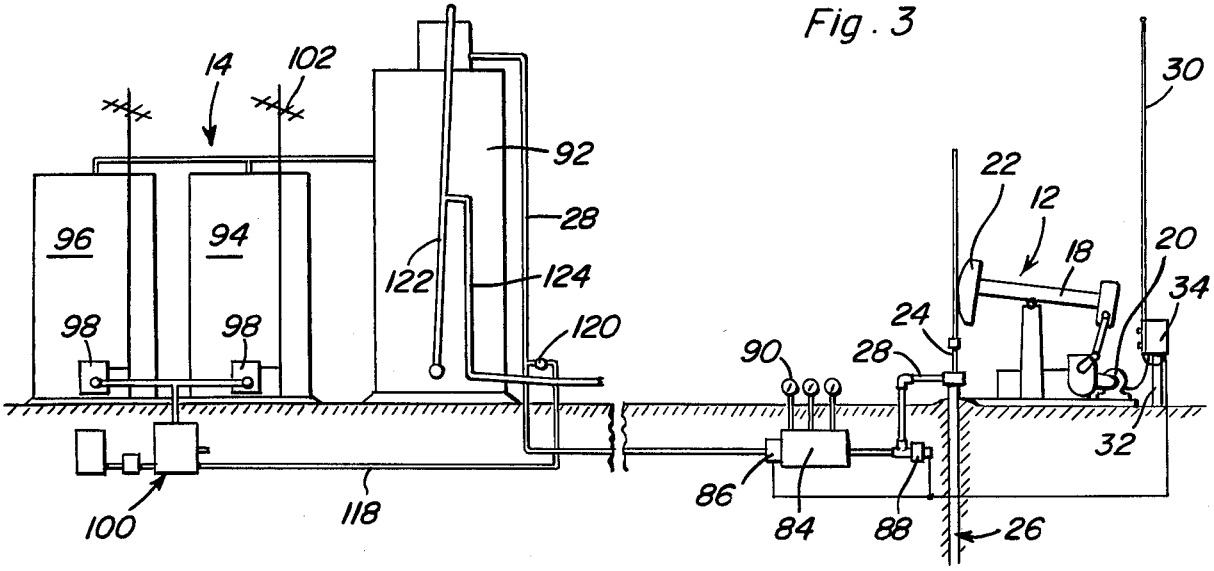
FIG. 3 is a schematic view illustrating one of the oil well pumping units and the association of the control unit therewith.

Referring now specifically to the drawings, FIG. 1 illustrates schematically an oil field including a plurality of producing oil wells 10 each of which includes a pump jack generally designated by numeral 12. The oil wells 10 are associated with a group of tanks 14 and a remote centrally located building 16 is illustrated to depict a site in which the operating conditions of the oil wells 10 in the oil field can be controlled, monitored and recorded. As illustrated in FIG. 3, each pumping unit 12 includes the usual pump jack 18 driven by a motor 20 with the horse head of the pump jack being connected to the pump rod or polish rod 24 which extends down through the casing and production tubing generally designated by numeral 26 to the down hole pump in a conventional and well-known manner with the production tubing being communicated with a flow line 28 at the upper end thereof for the crude oil being produced to flow to the tanks 14 in a manner which is conventional.

An essential component of the control unit of the present invention is the provision of a variable speed and variable cycle AC motor designated by numeral 20 for powering the pumping unit 12. The variable speed characteristics of the variable speed AC motor allows the pump "strokes per minute" to be varied by an operator simply rotating a small control knob. This enables the down hole pump to be operated at maximum efficiency, that is, the pumping capacity of the pump may be varied to be equal to the production capacity of the formation. In other words, each time the pump is reciprocated, the pump barrel will be completely filled by production fluid from the formation so that each stroke of the pump plunger will pump its design volume of production fluid thereby enabling the maximum use of electrical energy for powering the motor and maximum efficiency of the pumping unit. The variable cycle of the variable speed AC motor 20 enables the speed of the upstroke of the reciprocating cycle to be adjustably varied relative to the downstroke. Thus, the downstroke may be slowed down so that excessive pounding against fluid columns and the resultant shock and vibration of the rod, tubing pump and pumping unit can be eliminated and controlled by the operator adjusting a small control knob.

Figure 4:
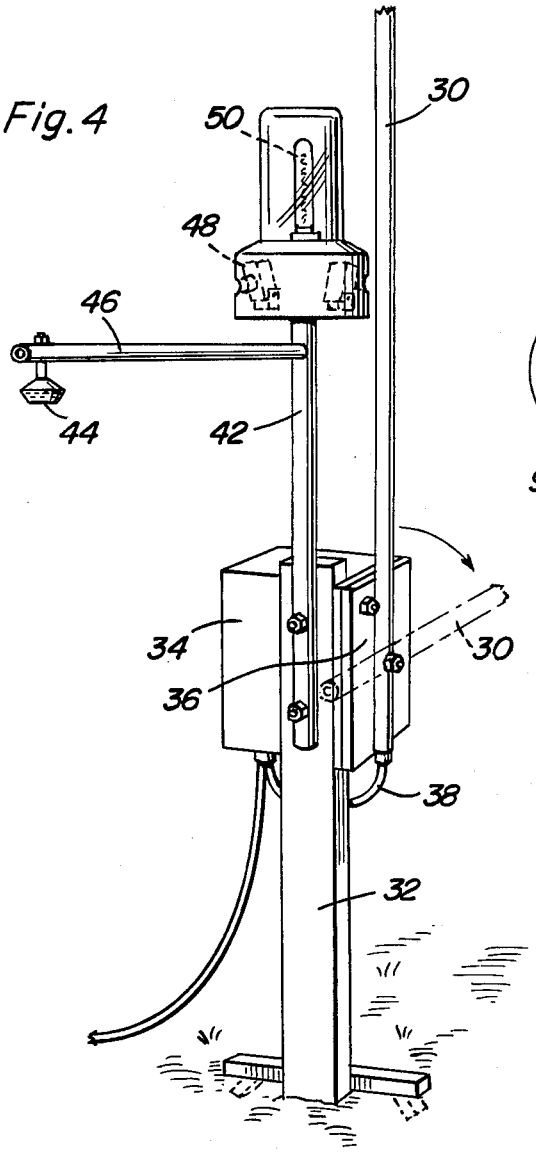
FIG. 4 is a perspective view of one of the control units, transceiver and security device associated with an oil well site.

Each oil well is also provided with a vertically elongated mast and antenna 30 supported from a supporting post 32, or the like which has a control box 34 at the upper end thereof and supporting plate structure 36 for the antenna 30 to enable the antenna 30 to be lowered to a generally horizontal position, as illustrated in broken line in FIG. 4 for replacement or repair with the lower end of the antenna 30 including a lead 38 extending into the control box 34 with the lead 38 being coaxial or of any other suitable construction to enable transmission and reception of signals in relation to an antenna 40 located on the centrally located remote building 16, as illustrated in FIG. 1.

Also supported on the vertical post 32 is an upstanding support member 42 having a sensing device 44 supported laterally therefrom by a supporting arm 46. A plurality of camera units 48 are supported at the upper end of the support member 42 and a light 50 is disposed above the camera units 48 with the camera units and the light 50 being operated in response to the presence of unauthorized persons in the vicinity of the oil well 10. The light may be in the form of a Xenon tube of the type employing a capicator discharge and the sensing device may be an acoustic sensor or any other suitable type of sensor which will control a circuit to the cameras and flashing light with the cameras and flashing light being synchronized in a manner that the plurality of cameras will be alternately operated at the same time that the light flashes to enable the area surrounding the oil well to be photographed by the cameras with the operation of the cameras and light being responsive to unauthorized persons adjacent the oil well or in the oil field.

The variable speed variable cycle AC motor 20 will include a separate but integral cooling system driven by a separate motor so that cooling can be effected at relatively low speeds. Also, the motor 20 includes a high and low power cut out with the high power cut out automatically stopping the motor in the event that seizure of some part of the pumping unit should occur, such as the sticking of the down hole pump plunger or any other factor that would cause the motor to encounter a load above its preset power limits. The low power cut out feature will automatically shut down the motor in the event that the drive belts from the motor should break or if there is a breakage in the pump rods or polish rods or whenever the motor should encounter a load below a preset power limit.

Figure 2:
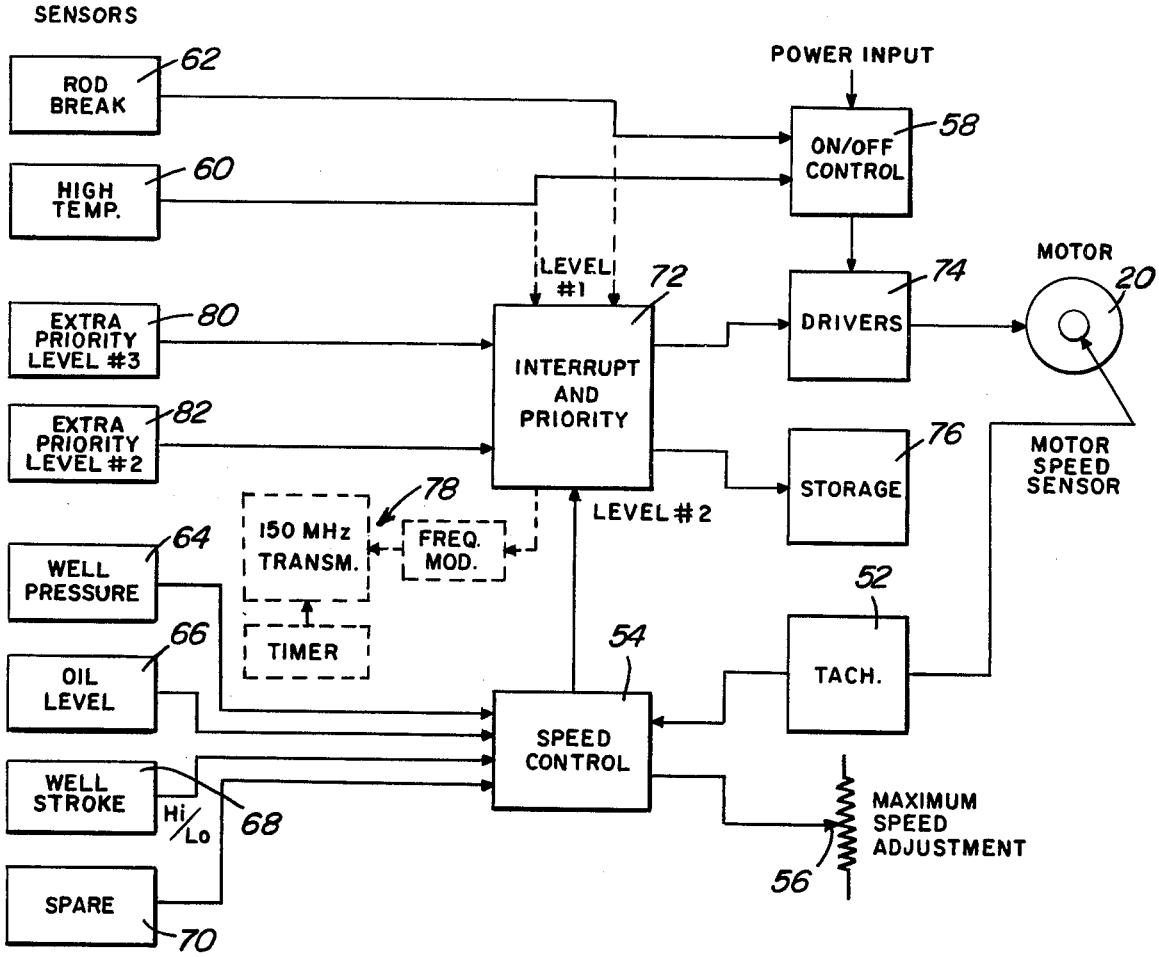
FIG. 2 is a diagrammatic view of the control unit of the present invention.

As diagrammatically illustrated in FIG. 2, the motor 20 is provided with a motor speed sensor that provides an input into a tachometer 52 which in turn inputs into a speed control 54 which includes a maximum speed adjustment 56 which is manually set for each well. Power input to the system is through an on/off control 58 with a high temperature sensor and control 60 connected therewith which allows the operator to manually set any shut down temperature along with a restart temperature to which the motor will automatically respond. This sensor is integral to a high/low pressure sensor located in the flow line which connects the pumping unit to the tank assembly 14 which includes the oil separator, heater, treater, or other collecting vessels. The temperature control sensor and the high/-low pressure sensor allows the motor to function within preset ranges. Also, in the event breakage or leakage occurs in the flow line, the fluid level drop in any vertical lines will cause the sensors to shut down the motor. In the event of freeze-up or blockage, the sensor responds to pressure build-up above certain preset levels thus shutting down the system before flow line breakage can occur. A vibration sensor is mounted on the pumping unit so that excessive vibrations of the unit above preset levels of tolerance will shut down the system to avoid damage and down time for repairs. Should excessive vibration occur due to mechanical failure, such as pitman arm breakage, or the like, the motor will shut down before critical damage to the unit can occur. A rod break sensor 62 may be used to sense the breakage of any of the pump rods, polish rods, or the like, and shut down the system before damage occurs. Also, the speed control 54 includes input from a well pressure sensor 64, an oil level sensor 66, a stroke sensor 68 and additional or spare inputs 70 may be provided, with the speed control including an input to an interrupt and priority assembly 72 which controls drives 74 to the motor 20 and also to a data storage assembly 76 and a tranceiver unit 78 which is timer controlled for transmitting and receiving information in relation to a recording and monitoring assembly and a control assembly in the building 16. Additional inputs 80 and 82 may be provided for the assembly 72 for various optional controls for the pumping unit. The power unit may be 440 or 220 volt three phase AC or the unit may be modified to use any voltage and either three phase or single phase, although the single phase will require DC motors and controls suitable for DC. The pump motor may have any horse power output ranging from 5 horse power up depending upon the requirements of the pumping unit. The transceiver unit and timer and the data storage unit 76 are stantard components with the transceiver unit operating on an assigned frequency and power output. The building 16 may include a recording and monitoring device that can be switched from one well to the other and control units for varying the operating conditions of the well.

Figure 5:
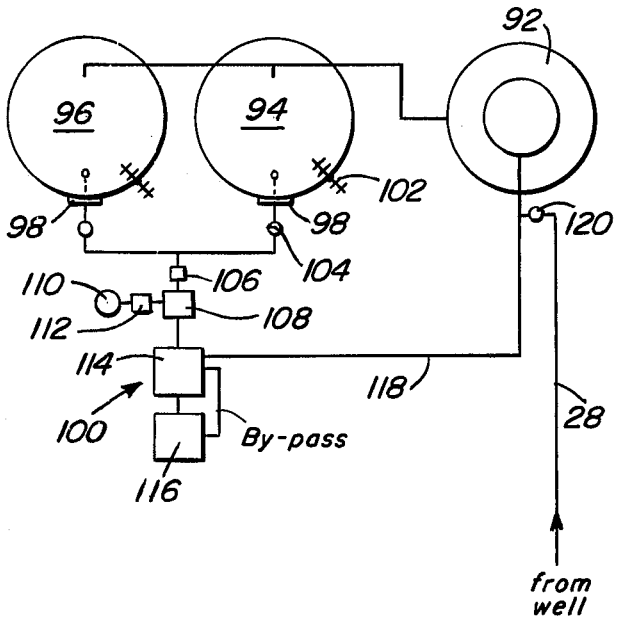
FIG. 5 is a top plan schematic view of the tank and separator units.

FIG. 3 illustrates schematically a chemical analyzer 84 incorporated into the flow line 28 between a flow meter 86 and a pressure transducer 88 with suitable gauge type indicators, or the like, 90. The purpose of the flow line pressure transducers is for the sensing of pressures either above or below adjustable levels as each well will be different depending on the elevation of the tank battery relative to the pumping unit. The primary purpose of this feature is to prevent flow line breakage and the resulting losses and pollution, and also to shutdown the pumping unit in the event of line breakage for reasons other than pressure. The primary purpoe of the flow meter or meters is to measure total production of oil, water and gas. This information will be stored and transmitted during interrogation to the central office. This information will be used to determine the production levels of each individual well and collectively from the total field reservoirs. Thus, engineering data for purposes of calculating decline curves, profit and loss margins, secondary recovery predictables, accounting and bookkeeping, periodic government requests for accumulating production totals and estimated reserves can be accomplished easily and accurately. In addition to the primary purpose of the items described above, the data supplied by these features will also be used in logic circuitry for more advanced control determinates; such as total oil sold and total accumulating volume of oil in storage, total salt water disposal requirements, etc. The analyzer indicates chemical composition of the fluid being pumped to the oil separator tank 92. This information can be used to automatically inject inhibitors into the oil well for complete chemial balancing of the well against down hole corrosion, paraffin, gypsum, and the like, thus extending the life expectancy of the pump string and bottom hole pump and further reducing the cost of chemicals injected into the well by injecting only those chemicals and only in the quantity necessary to properly balance the chemical composition of the well. As shown in FIGS. 3 and 5, the oil separator 92 and the storage tanks 94 and 96 associated therewith are monitored by B.S.& W. monitors and hydrostatic head sensors 98. The purpose of the B.S.& W. monitor 98 and processor 100 is to continuously measure and process out the accumulating tank bottoms automatically. In addition to this, there will be a hydrostatic head measuring device incorporated with the B.S.& W. monitor. This will be calibrated to measure total accumulating fluid volumes in each storage tank. This information will be transmitted to the pumping unit and stored for transmission back to the central office. This information will enable the operator to determine when a storage tank is full and ready for sale. In addition to this, tank volume information will be used in logic circuitry to balance total oil produced at the well head against total oil sold, and other logic circuit data, such as small leakage loss and evaporative loss.

Each monitor includes an intenna 102 to transmit data to the central office or to receive signals and the monitor-processor includes solenoid valves 104, a B.S.& W. pump 106, a mixer 108, a demulsifier 110, a demulsifier pump 112, a processor heater 114, a processor filter 116 and a flow line 118 for processed B.S.& W. to flow to the line 28 from the well to the separator which includes a check valve 120. The separator 92 also includes a salt water siphon 122 having discharge line 124 to a disposal site.

Many other control and monitoring features may be incorporated into the unit enabling the unit to be used in combination with various types of oil wells, such as secondary recovery wells. Logic circuits may be provided for programming and to consider various physical characteristics of the well in order to predict the flow rate of the formation, reserves, and the like. A color coded light signal may be provided to indicate to an observer which well may be shut down and the reason for the shut down. The optimum operation of the pump speed will be sensed and controlled by an electronic window detector that senses current excursions; when fluid pound occurs, an excursion will appear in the window detector which will trigger a slow down of the motor; the motor will slow down in timed intervals until the current excursions disappear, then at timed intervals the motor will speed up until the current excursion reappears, then slow down again until said excursions disappear. Thus, the optimum speed of the motor will be maintained relative to the yield of fluids from the oil reservoirs.

The foregoing is considered as illustrated only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A control unit for oil well pumping units of the type having a pump jack comprising an AC electric motor powering the pump jack, said AC motor having a variable speed and variable cycle to enable the pump jack to be operated at a speed to operate the down hole pump at a strokes per minute to provide a production capacity of the pump equal to the production fluid flowing from the formation, said variable cycle of the motor enabling the upstroke of the pump to be at a greater speed than the downstroke thereby eliminating pounding due to fluid columns engaged by the pump plunger during its downstroke.

2. The structure as defined in claim 1, together with transceiver means located at the oil well site for transmitting signals between the oil well site and a remote location to enable remote control and monitoring of the oil well.

3. The structure as defined in claim 1, together with a plurality of sensor devices for sensing the presence of abnormal conditions and controlling the pump jack and motor in response thereto.

4. The structure as defined in claim 1, together with an acoustic sensor associated with the oil well and operatively associated with an illuminating means and camera means for photographically recording the presence of unauthorized persons adjacent an oil well.

5. The structure as defined in claim 1, together with a flow line extending from the oil well to an oil separator tank and storage tanks, a chemical analyzer incorporated into the flow line for analyzing the production fluid flowing from the oil well to indicate the chemical composition thereof to enable appropriate injection of corrosion inhibiting chemicals or other required chemicals into the oil well for maintaining chemical belance of the down hole portion of the well.

6. The structure as defined in claim 5, together with a pressure transducer in the flow line to sense the flow line pressure above or below an adjustment pressure level to prevent flow line breakage and to shut down the pumping unit in the event of line breakage for reasons other than pressure., a flow meter in the flow line to measure total production from the well.

7. The structure as defined in claim 1, wherein the AC motor includes independently driven cooling means to maintain temperature operating conditions within certain preset limits, a temperature sensor for stopping the pump jack when temperature conditions reach a predetermined high temperature, and a high and low load sensor to stop operation of the pump jack in the event of binding of components or other high load condition or breakage of components or other low load conditions.

8. The structure as defined in claim 7, together with transceiver means located at the oil well site for transmitting signals between the oil well site and a remote location to enable remote control and monitoring of the oil well, and a plurality of sensor devices for sensing the presence of abnormal conditions and controlling the pump jack and motor in response thereto, and an acoustic sensor associated with the oil well and operatively associated with an illuminating means and camera means for photographically recording the presence of unauthorized persons adjacent an oil well.

* * * * *